US007419754B2

(12) United States Patent
Morales-Tirado et al.

(10) Patent No.: US 7,419,754 B2
(45) Date of Patent: Sep. 2, 2008

(54) PARTICLE HAVING CONDUCTIVE POLYMER SURFACE ADDITIVE

(75) Inventors: Juan A Morales-Tirado, West Henrietta, NY (US); Scott M Silence, Fairport, NY (US); Joo T Chung, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 371 days.

(21) Appl. No.: 11/094,412

(22) Filed: Mar. 31, 2005

(65) Prior Publication Data

US 2006/0222993 A1 Oct. 5, 2006

(51) Int. Cl.
*G03G 9/093* (2006.01)

(52) U.S. Cl. ..... 430/110.1; 430/110.2

(58) Field of Classification Search ..... 430/110.2, 430/110.1

See application file for complete search history.

(56) References Cited

U.S. PATENT DOCUMENTS

| | | | | |
|---|---|---|---|---|
| 4,935,326 | A | 6/1990 | Creatura et al. | |
| 4,937,166 | A | 6/1990 | Creatura et al. | |
| 5,624,079 | A | 4/1997 | Higuchi et al. | |
| 6,242,147 | B1 * | 6/2001 | Anno et al. | 430/108.2 |
| 6,299,800 | B1 * | 10/2001 | Viswanathan | 252/500 |
| 6,485,874 | B1 * | 11/2002 | Moffat et al. | 430/108.22 |
| 6,495,301 | B2 | 12/2002 | Everaars et al. | |
| 6,503,678 | B1 * | 1/2003 | Moffat et al. | 430/108.5 |
| 6,511,780 | B1 | 1/2003 | Veregin et al. | |
| 6,850,725 | B2 | 2/2005 | Silence et al. | |
| 2001/0031416 | A1 * | 10/2001 | Everaars et al. | 430/110.2 |
| 2003/0175609 | A1 * | 9/2003 | Combes et al. | 430/108.22 |

FOREIGN PATENT DOCUMENTS

| | | | |
|---|---|---|---|
| JP | A 3-100561 | | 4/1991 |
| JP | 2004189796 | * | 7/2004 |

OTHER PUBLICATIONS

Abstract of JP2004189796, Jul. 8, 2004.*
Machine English language translation of JP2004189796, Jul. 8, 2004.*

* cited by examiner

*Primary Examiner*—Hoa V Le
(74) *Attorney, Agent, or Firm*—Oliff & Berridge, PLC

(57) ABSTRACT

Particles, preferably toner particles comprised of at least binder and colorant, are described that include a doped conductive polymer material as a surface additive on the external surface of the particle. The presence of the doped external conductive polymer material enables the particles to retain a substantially uniform charge distribution over the surface of the particles over time, and also enables appropriate control over the triboelectric (tribo) properties of a developer. Also described are developers comprised of such particles in admixture with carrier particles, and methods of making the particles and developers.

16 Claims, No Drawings

PARTICLE HAVING CONDUCTIVE POLYMER SURFACE ADDITIVE

BACKGROUND

Described herein are particles, preferably toner particles comprised of at least binder and colorant, having a doped conductive polymer material as a surface additive on the external surface of the particle. The presence of the external doped conductive polymer material enables the particles to retain a substantially uniform charge distribution over the surface of the particles over time, and also enables appropriate control over the triboelectric (tribo) properties of a developer. Also described are developers comprised of such particles in admixture with carrier particles, and methods of making the particles and developers.

It is desirable for toner particles to exhibit a substantially uniform charge distribution over the surface of the toner particles. A freshly made toner typically exhibits a substantially uniform charge distribution, probably because the external additives on the toner particle surface are able to move sufficiently on the toner particle surface to permit the charge to be evenly distributed over the surface of the toner particle. However, it has been found that over time, as the external additives become fixed into the toner particle surface, for example as a result of impaction through collisions with other toner particles and/or carrier particles, the charge distribution over the surface becomes increasingly non-uniform. This is problematic in that the toner particles may not exhibit uniform charging characteristics, and thus may not develop images of uniform quality. Non-uniform charge distributions on the surface of a particle may also create higher local electric fields on the particles, causing higher levels of electrostatic adhesion to all surfaces in the xerographic engine (for equivalent tribo levels), which in turn leads to decreased levels of development and transfer from the photoreceptor to paper over time.

Moreover, some developers exhibit very high developer triboelectric properties. If developer tribo is too high, at least two adverse effects may be realized. First, high developer tribo makes development more difficult because a higher bias is required to develop the toner onto the photoreceptor. In certain cases, the developed mass per unit area (DMA) is not uniform, causing severe print quality defects. Second, high developer tribo may result in significant accumulation of toner on the wires in the developer housing, resulting in what is known as wire contamination. This can cause visible streaks on the prints.

One approach that has been developed to control the developer tribo is to change the coating on the carrier particles of the developer. For example, addition of a silicone rubber to the surface of the carrier particles has been attempted. This approach has the advantage of being able to tune developer tribo independent of the toner properties. However, subsequent contact of the toner particles with surfaces in the system such as the donor roll, wires, photoreceptor, etc., may still result in an increase in the charge on the toner.

An alternative method may be to adjust the amounts of the external surface additives used on the toner particles. The disadvantage to this approach is that adjustment of the external additive amounts alters other toner properties besides tribo, and the tradeoff is therefore not advantageous.

U.S. Pat. No. 6,511,780 describes a carrier comprised of a mixture of insulating carrier particles and conductive carrier particles in which the conductive carrier particles contain a conductive component. Either of the particles may be provided with a coating of, e.g., polyaniline.

U.S. Pat. No. 6,495,301 describes a toner comprising separate toner particles each of which comprises a fixable core, the core being provided with a conductive surface layer containing a doped electrically conductive polymer and an intermediate layer, particularly a polymer-containing intermediate layer disposed between the surface layer and the core. The intermediate layer is preferably comprised of polymethyl methacrylate, polyvinyl alcohol, polyvinyl pyrrolidone and copolymers of maleic acid and olefins. The doped electrically conductive polymer of the conductive surface layer is preferably derived from at least one monomer selected from the group consisting of thiophene, aniline, pyrrole or derivatives thereof.

In the background section, U.S. Pat. No. 6,495,301 discusses JP 3-100561. This Japanese publication describes obtaining a toner stable in conductivity at low cost by attaching a doped conductive polymer to the surface of each core particle. The conductive polymer, such as an oxidation polymer of aniline, pyrrole, thiophene and derivatives thereof, is attached to the surface of each core particle for composing the toner by immersing the core particles into at least one kind of solvent, such as water or methanol, and stirring them in the presence of at least one kind of monomer, such as aniline or pyrrole, and an oxidant and a dopant, thus permitting an electrophotographic toner satisfying the requirement of stability to be obtained at low cost.

SUMMARY

What is still desired is a novel manner of effectively maintaining the uniformity of charge distribution on the surface of toner particles over time, and/or controlling developer tribo without adversely affecting other significant properties required of the toner. It is therefore an object herein to develop solutions to these and related issues.

These and other objects are achieved herein.

In one embodiment, a particle is described that is comprised of at least binder and colorant, wherein the particle includes on an external surface thereof a coating comprised of a doped conductive polymer material on or in a particle matrix.

In another embodiment, a developer is described that comprises toner particles and carrier particles, wherein the toner particles comprise at least binder and colorant, and wherein the toner particles include on an external surface thereof a coating comprised of a doped conductive polymer material on or in a particle matrix.

In a still further embodiment, described is a method of applying a doped conductive polymer onto an external surface of particles, comprising forming a material comprised of binder and colorant, subjecting the material to physical size reduction to form particles, and introducing a doped conductive polymer material during the physical size reducing step so as to form a coating of the doped conductive polymer material on the external surface of the particles.

In a still further embodiment, described is a method of applying a doped conductive polymer material onto an external surface of core particles, comprising incorporating the doped conductive polymer material onto and/or into external additive particles, and applying the external additive particles onto the external surface of the core particles.

DETAILED DESCRIPTION OF EMBODIMENTS

In a first embodiment, the present subject matter relates to a particle comprised of at least binder resin, and preferably to a toner particle that further includes at least one colorant with the binder resin, and the particle including on an external surface thereof a coating comprised of a doped conductive polymer material on or in a particle matrix.

The binder is not limited, and any suitable binder resin may be used. In preferred embodiments, the binder is any binder resin suitably used in the manufacture of toner particles.

As non-limiting examples of suitable binder resins usable herein, mention may be made of vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins selected for the toner compositions of the present invention include homopolymers or copolymers of two or more monomers. Furthermore, the above-mentioned polymer resins may also be crosslinked.

In a preferred embodiment, the binder resin is comprised of a polyester resin that includes both crosslinked and linear portions. For example, polyester resins obtained from the reaction of bisphenol A and propylene oxide, and in particular including such polyesters followed by the reaction of the resulting product with fumaric acid, and branched polyester resins resulting from the reaction of dimethylterephthalate with 1,3-butanediol, 1,2-propanediol, and pentaerythritol may be used. The crosslinked portion of the binder is comprised of microgel particles with an average volume particle diameter up to 0.1 micron, more specifically about 0.005 to about 0.1 micron, as determined by scanning electron microscopy and transmission electron microscopy, the microgel particles being substantially uniformly distributed throughout the linear portions. This resin may be prepared by a reactive melt mixing process as known in the art. The highly crosslinked dense microgel particles distributed throughout the linear portion impart elasticity to the resin, which improves the resin offset properties, while not substantially affecting the resin minimum fix temperature.

The crosslinked portion may comprise very high molecular weight microgel particles with high density crosslinking (as measured by gel content) and which are not soluble in substantially any solvents such as, for example, tetrahydrofuran, toluene and the like. The microgel particles are highly crosslinked polymers with a very small, if any, crosslink distance. This type of crosslinked polymer may be formed by reacting chemical initiator with linear unsaturated polymer, and more specifically linear unsaturated polyester, at high temperature and under high shear. A weight fraction of the microgel (gel content) in the resin mixture of from about 0.001 to about 50 weight percent, from about 1 to about 20 weight percent, and about 1 to about 15 weight percent, and yet more specifically about 2 to about 10 weight percent. The linear portion is comprised of base resin, more specifically unsaturated polyester, in the range of from about 50 to about 99.999 percent by weight of the toner resin, and more specifically in the range of from about 80 to about 98 percent by weight of the toner resin. The linear portion of the resin preferably comprises low molecular weight reactive base resin that did not crosslink during the crosslinking reaction, more specifically unsaturated polyester resin.

Preferred unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. A particularly preferred polyester is poly(propoxylated bisphenol A fumarate). Linear propoxylated bisphenol A fumarate resin is available under the tradename SPAR II™ from Resana S/A Industrias Quimicas, Sao Paulo Brazil, or as NEOXYL P2294™ or P2297™ from DSM Polymer, Geleen, The Netherlands, for example. Additional information regarding such polyester binder may be found in, for example, U.S. Pat. No. 6,850,725, incorporated herein by reference.

The resin may comprise about 40 to about 98 percent by weight, and more preferably from about 70 to about 98 percent by weight, of the particle.

The particles may be made by any suitable process, including both physical and chemical processes. Physical processes include forming a mass of the binder resin, and then physically reducing the size thereof to a desired average particle size range, for example by grinding, milling, etc. Chemical processes include forming the particles in a reaction medium such as an emulsion by building the particles up to a desired particle size via polymerization of the resin materials. Both methods of forming particles are well known in the art and need not be further described herein.

The particles further preferably include at least one colorant. The colorant is also not limited, and may be any suitable colorant or colorant mixture, including pigments, dyes, etc. As a few specific, non-limiting examples, mention may be made of REGAL 330™ (Cabot), Acetylene Black, Lamp Black, Aniline Black; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Other colorants are magenta colorants of (Pigment Red) PR81:2, CI 45160:3. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Forum Yellow SE/GLN, CI Dispersed Yellow 33 2,5-dimethoxy-4-sulfonanilide phenylazo-4'-chloro-2,5-dimethoxy acetoacetanilides, and Permanent Yellow FGL, PY17, CI 21105, and known suitable dyes, such as red, blue, green, Pigment Blue 15:3 C.I. 74160, Pigment Red 81:3 C.I. 45160:3, and Pigment Yellow 17 C.I. 21105, and the like.

The colorant may be incorporated with the binder in an amount sufficient to impart the desired color to the particles. In general, pigment or dye is selected, for example, in an amount of from about 1 to about 60 percent by weight of the particle, and more preferably from about 1 to about 25 percent by weight of the particle.

The particles may also include additional optional additives therein such as, for example, waxes, charge carrier or control additives, surfactants, emulsifiers, pigment dispersants, flow additives, embrittling agents, and the like.

The particles include a coating of a doped conductive polymer material on an external surface thereof. As the polymer material, any so-called inherently conductive polymer material may be used. Examples of such polymers include polymers derived from one or more of thiophene, aniline, and pyrrole. Polyaniline and polypyrrole and particularly preferred.

In such polymers, the polymer chain itself provides the electrical conduction path via its conjugated bond structure, e.g., containing both single and double bonds alternating throughout the structure.

Electrons, or holes, are induced in the polymer by means of a doping agent. As the dopant, any oxidizing or reducing agent may be used, the dopant modifying the electronic structure of the polymer so that it can conduct electrical current. The degree of conductivity is related to factors such as polymeric structure, degree of doping, and type of dopant. The dopant may be introduced via any suitable doping process, particularly a chemical or electrochemical process. Processes of this kind may comprise an oxidation or reduction reaction, in which electrons are removed or added to the polymer chain. Typical oxidative dopants include iodine, arsenic pentachloride, iron(III) chloride, and $NOPF_6$. A typical reductive dopant is sodium naphthalide.

In a preferred embodiment, the doped conductive polymer material is a polyaniline polymer or copolymer that is grafted with an additional material. Preferably, the additional material is lignosulfonic acid. Such a grafted material is commercially available as TESLART™, available from PolyOne Corporation.

In prior art processes such as described in the background section above, the doped conductive polymer material is coated directly onto the particle surface, for example from a solution into which the particle is immersed. See, for example, both JP 3-100561 and U.S. Pat. No. 6,495,301. While such techniques may be suitable for some applications, this technique has not proven to be ideal.

In one embodiment herein, the doped conductive polymer material is incorporated onto or into a particle matrix. The particle matrix that contains the doped conductive polymer material is attached to the external surface of the core particles. The doped conductive polymer material is thus supported on a particle, smaller in size than the core particle, which smaller particle is attached as an external additive upon the external surface of the core particle.

In preferred embodiments, the core particle has an average size of from, for example, about 1 to about 50 micrometers, preferably from about 2 to about 25 micrometers, preferably from about 3 to about 12 micrometers. The smaller size particles that support the doped conductive polymer material preferably have a size of 250 nm or less, preferably 100 nm or less, more preferably about 50 nm or less.

As the particles of the external particle matrix that support the doped conductive polymer material, any particle material may be used without limitation. The particle may be of a type conventionally used as an external additive upon toner particle external surfaces, or it may simply be a carrier particle functioning to carry the doped conductive polymer material. Preferred examples of suitable particle matrix materials include, for example, silica, titania, alumina, strontium titanate, cerium oxide, UNLIN™, carbon black or mixtures thereof.

As the particles supporting the doped conductive polymer material and/or as an external additive for the core particles, preferred additive particles include, for example, one or more of $SiO_2$, metal oxides such as, for example, $TiO_2$ and aluminum oxide, and a lubricating agent such as, for example, a long chain alcohols such as UNILIN 700™.

In general, silica is applied to a toner particle surface for toner flow, tribo enhancement, admix control, improved development and transfer stability and higher toner blocking temperature. Titania is applied for improved relative humidity (RH) stability, tribo control and improved development and transfer stability. The $SiO_2$ and $TiO_2$ may preferably have a primary particle size of at least about 30 nm, preferably of at least about 40 nm, with the primary particles size measured by, for instance transmission electron microscopy (TEM) or calculated (assuming spherical particles) from a measurement of the gas absorption, or BET, surface area. The most preferred $SiO_2$ and $TiO_2$ have been surface treated with compounds including DTMS (dodecyltrimethoxysilane) or HMDS (hexamethyldisilazane). Examples of these particle additives include DTMS silica, obtained from Cabot Corporation, comprised of a fumed silica, for example silicon dioxide core L90 coated with DTMS; H2050EP silica, obtained from Wacker Chemie, coated with an amino functionalized organopolysiloxane; TS530 from Cabot Corporation, Cab-O-Sil Division, a treated fumed silica; SMT5103 titania, obtained from Tayca Corporation, comprised of a crystalline titanium dioxide core MT500B, coated with DTMS; MT3103 titania, obtained from Tayca Corporation, comprised of a crystalline titanium dioxide core coated with DTMS. The titania may also be untreated, for example P-25 from Nippon Aerosil Co., Ltd.

Zinc stearate is preferably also used as an external additive, the zinc stearate providing lubricating properties. Zinc stearate provides developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. Most preferred is a commercially available zinc stearate known as ZINC STEARATE L™, obtained from Ferro Corporation.

Preferably, the particles may contain from, for example, about 0.1 to 5 weight percent titania, about 0.1 to 8 weight percent silica and about 0.1 to 4 weight percent zinc stearate. More preferably, the toners contain from, for example, about 0.1 to 3 weight percent titania, about 0.1 to 6 weight percent silica and about 0.1 to 1 weight percent zinc stearate. The relative amounts of additives can be manipulated to provide a range of desirable properties for the core particles.

In a preferred embodiment, the doped conductive polymer material is comprised of polypyrrole polymer or copolymer carried on or in a carbon black particle. Such materials are commercially available as Eeonomer™ 200F, Eeonomer™ 30F, and Eeonomer™ 300F, all from EEONYX Corporation. For these materials, the average composite (carbon black) particle size is about 40 nm, as determined by transmission electron microscopy. In another preferred embodiment, the doped conductive polymer material is comprised of a polyaniline polymer or copolymer, including grafted material as discussed above, carried on or in a small sized silica particle.

In addition to the aforementioned external additives, a charge control additive may also be included on the surface of the core particles.

The doped conductive polymer material may be incorporated onto or into the supporting particle matrix in any suitable manner. For example, the doped conductive polymer material may be formed in situ on or in the particles from a reaction dispersion that contains the polymer precursors and the particles. The particles may also receive the doped conductive polymer via spraying of a dispersion containing the polymer. Still further, the external particles and a dry form of the doped conductive polymer material may be dry blended together.

The amount of doped conductive polymer material added to the surface of the core particles is relatively small. If too much is added, the tribo properties of the particles are too adversely affected. Accordingly, it is preferable to include the doped conductive polymer material in an amount of from about 0.01 to about 5% by weight of the core particles, more preferably from about 0.02 to about 1% by weight of the core particles.

The particles supporting the doped conductive polymer material may be applied to an external surface of the core particles via any suitable process. The external particles are most suited for mechanical attachment, for example such as used with other conventional external surface additives. Preferably, the particles are applied to the core particles via a mechanical mixing technique, e.g., blending, grinding, jet milling, etc., wherein the smaller sized particles are applied and attached to the external surfaces of the core particles.

In such application techniques, the particles supporting the doped conductive polymer material may be added alone or in combination with other conventional external surface additives such as discussed above. The particles supporting the doped conductive polymer material may be added before, during or after application of other surface additives upon the external surface of the core particles.

In an alternative embodiment, it has also been found suitable to directly apply the doped conductive polymer material to the core particle where the core particle is made via a physical process and the doped conducive polymer material is introduced via injection into the grinding stage of the core particles.

Injection of materials at the grind stage of particle formation is known in the art. For example, U.S. Pat. No. 5,624,079, incorporated herein by reference in its entirety, describes an apparatus for injecting external additives into the grinding chamber where core toner particles are reduced in size. The apparatus may be a jet mill, grinder, etc. In this embodiment, the doped conductive polymer material is preferably formed into a dispersion, most preferably an aqueous dispersion, having a solids content of from about 1 to about 20%, preferably of from about 2 to about 10%. The dispersion is injected into the grind chamber having the core particles undergoing size reduction therein. The atmosphere within the chamber is sufficiently warm and dry that the aqueous phase is absorbed in the dry air, and the doped conductive polymer material is deposited upon and attached to the external surface of the core particles.

The coated particles described herein are most preferably toner particles that include a colorant in the core particles. Preferably, the toner particles are mixed with carrier particles to achieve a two-component developer composition. Preferably, the toner concentration in each developer ranges from, for example, 1 to 10%, more preferably 2 to 8%, by weight of the total weight of the developer.

These toner particles may be used in forming a developer by admixing with one or more carrier particles. Any carrier particle may be used without limitation. Carrier particles that can be selected for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference. In a preferred embodiment, the carrier may comprise a steel particle having a size of about 80 micrometers.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluoroethylenes, other known coatings and the like. The carrier core is preferably at least partially coated with a polymethyl methacrylate (PMMA) polymer having a weight average molecular weight of 300,000 to 350,000 commercially available from Soken. The coating preferably has a coating weight of from, for example, 0.1 to 3.0% by weight of the carrier, preferably 0.5 to 1.3% by weight. The PMMA may optionally be copolymerized with any desired comonomer, so long as the resulting copolymer retains a suitable particle size. Suitable comonomers can include monoalkyl, or dialkyl amines, such as a dimethylanmoethyl methacrylate, diethylaminoethyl methacrylate, diisopropylaminoethyl methacrylate, or t-butylaminoethyl methacrylate, and the like.

The developer composition may be included in an electrostatographic/xerographic device in order to form an image upon an image receiving member. An imaging member (e.g., photoreceptive member) of the device is imaged by first uniformly electrostatically charging the surface thereof. The member is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing toner particles, for example from the developer composition, on the surface of the member. The resulting visible toner image can be transferred to a suitable image receiving medium such as paper.

By coating toner core particles with the doped conductive polymer material in the form and manner described herein, a functional and stable tribo level can be achieved and maintained over time, and thus development stability may be obtained. The stability of the tribo is believed to be achieved as a result of a uniform charge patch density being maintained over the toner surface due to the inclusion of the doped conductive polymer material thereon.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A particle comprising a core comprised of at least a binder, wherein the core includes on an external surface thereof a coating comprised of a particle matrix including a doped conductive polymer material, wherein the particle matrix is comprised of particles having a size smaller than a size of the core, wherein the doped conductive polymer is supported on or in the particles of the particle matrix, and wherein the coating is comprised of a particle matrix comprised of polypyrrole polymer or copolymer as the doped conductive polymer deposited on carbon black particles or is comprised of polyaniline polymer or copolymer as the doped conductive polymer deposited on silica particles.

2. The particle according to claim 1, wherein the polyaniline polymer or copolymer is grafted with an additional material.

3. The particle according to claim 2, wherein the additional material is lignosulfonic acid.

4. The particle according to claim 1, wherein the particle further comprises at least one colorant in the core.

5. A particle comprised of at least a binder, wherein the particle includes on an external surface thereof a coating comprised of a doped conductive polymer material on or in a particle matrix, wherein the particle matrix is comprised of particles having a size of less than 250 nm.

6. The particle according to claim 1, wherein the particle matrix is comprised of particles having a size of less than 50 nm.

7. A particle comprised of at least a binder, wherein the particle includes on an external surface thereof a coating comprised of a doped conductive polymer material on or in a particle matrix, wherein the particle matrix is comprised of silica, titania, alumina, strontium titanate, cerium oxide, a long chain alcohol lubricating agent, carbon black or mixtures thereof.

8. The particle according to claim 1, wherein the external surface of the core further includes at least one charge control additive.

9. The particle according to claim 4 further together with carrier particles.

10. A xerographic device including the particle and the carrier of claim 9 for forming an image on an image receiving medium.

11. A method of forming a particle, comprising forming core particles comprised of binder, incorporating a doped conductive polymer material onto and/or into external additive particles, and applying the external additive particles onto an external surface of the core particles to form a particle matrix coating thereon, wherein the external additive particles have a size smaller than a size of the core particles, wherein the doped conductive polymer is supported on or in the external additive particles of the particle matrix, and wherein the particle matrix coating is comprised of polypyrrole polymer or copolymer as the doped conductive polymer deposited on carbon black particles or is comprised of polyaniline polymer or copolymer as the doped conductive polymer deposited on silica particles.

12. The particle according to claim 5, wherein the doped conductive polymer material is a polymer or copolyiner of polyaniline or polypyrrole.

13. The particle according to claim 5, wherein the particle matrix is comprised of particles having a size of less than 50 nm.

14. The particle according to claim 5, wherein the particle matrix is comprised of silica, titania, alumina, strontium titanate, cerium oxide, a long chain alcohol lubricating agent, carbon black or mixtures thereof.

15. The particle according to claim 7, wherein the doped conductive polymer material is a polymer or copolymer of polyaniline or polypyrrole.

16. The particle according to claim 7, wherein the particle matrix is comprised of particles having a size of less than 250 nm.

* * * * *